US007493740B2

(12) United States Patent
Palumbo

(10) Patent No.: US 7,493,740 B2
(45) Date of Patent: Feb. 24, 2009

(54) APPARATUS AND METHOD FOR LOADING A BAG TRAIN

(75) Inventor: Riccardo Palumbo, Arona (IT)

(73) Assignee: Cryovac, Inc., Duncan, SC (US)

( * ) Notice: Subject to any disclaimer, the term of this patent is extended or adjusted under 35 U.S.C. 154(b) by 334 days.

(21) Appl. No.: 10/529,379

(22) PCT Filed: Sep. 26, 2003

(86) PCT No.: PCT/EP03/10754

§ 371 (c)(1),
(2), (4) Date: Mar. 28, 2005

(87) PCT Pub. No.: WO2004/031036

PCT Pub. Date: Apr. 15, 2004

(65) Prior Publication Data

US 2006/0151658 A1 Jul. 13, 2006

(30) Foreign Application Priority Data

Oct. 3, 2002 (EP) ..... 02256908

(51) Int. Cl.
*B65B 63/04* (2006.01)

(52) U.S. Cl. ..... 53/116; 53/117; 53/118; 53/591; 242/530.1; 242/530.2

(58) Field of Classification Search ... 242/530.1–530.2; 53/116–118, 591; 254/390
See application file for complete search history.

(56) References Cited

U.S. PATENT DOCUMENTS

| | | | | | |
|---|---|---|---|---|---|
| 3,406,592 | A | * | 10/1968 | Von Kaler | 475/230 |
| 3,587,843 | A | * | 6/1971 | Wing | 206/460 |
| 3,698,547 | A | * | 10/1972 | Roberts et al. | 206/389 |
| 4,032,038 | A | * | 6/1977 | Hendricks et al. | 221/71 |
| 4,693,372 | A | | 9/1987 | O'Neill | |
| 4,753,322 | A | * | 6/1988 | Yasuda | 187/254 |
| 4,796,412 | A | | 1/1989 | O'Neill | |

FOREIGN PATENT DOCUMENTS

GB 2 064 477 A 9/1981

* cited by examiner

*Primary Examiner*—Sang Kim
(74) *Attorney, Agent, or Firm*—Mark B. Quatt

(57) ABSTRACT

An apparatus for taking up imbricated bags carried by a pair of carrier tapes includes two carrier tape winding spools positioned coaxially with one another; and a differential gear unit positioned between said spools and adapted to be removably connectable to a shaft of a bag loader whereby the pair of carrier tapes can be wound up on said spools with equal tension. A method includes providing a bag train having a succession of imbricated bags on two supply tapes having lead ends equipped with two tape-winding spools with a differential gear unit positioned coaxially between the spools; connecting the differential gear unit to a shaft of said bag loader; and driving said spools to wind up said tapes on said spools with equal tension to bring each of the imbricated bags successively to a loading position where each bag is loaded and separated from the tapes.

8 Claims, 3 Drawing Sheets

APPARATUS AND METHOD FOR LOADING A BAG TRAIN

The present application is a 35 USC §371 application of PCT/EP03/10754 filed Sep. 26, 2003, which claims the benefit of EP Patent Application No. 02256908.1 filed Oct. 3, 2002.

FIELD OF THE INVENTION

The present invention relates to an apparatus for taking up tapes on which a succession of imbricated bags, suitable for packaging, are carried. For example, meat cuts, or poultry may be loaded into the bags as they are removed from the tapes by a bag loader.

BACKGROUND OF THE INVENTION

The use of taped imbricated bags has been known for many years and the most commonly available form of these bags uses two separate adhesive carrier tapes which have an imbricated array of the bags placed on the tapes in such a way that the adhesive face of each tape contacts the exposed part of each bag in the imbricated array. Normally the lead bag of the array is attached to the tapes by its end at which the mouth is disposed.

U.S. Pat. No. 4,798,412 discloses a bag loader which includes a differential drive unit which drives two driving shafts onto which a cassette can be loaded. The cassette contains two tape winding spools one for each tape of a chain of bags. The differential drive unit of the bag loader can wind up the tapes onto the spools with equal tension. However, the drive unit of the bag loader is complicated and requires many components because of the two shafts which must extend from the bag loader with axes which are parallel but not coaxial. Furthermore, such a cassette is required to hold the spools in place and is necessarily quite large and bulky as the spools are positioned one beside the other to allow connection to the two shafts of the drive unit of the bag loader.

GB 2,064,477 discloses a bag loader which includes a differential drive unit which drives two tape winding spools which are positioned coaxially with one another. The differential drive gear is permanently attached to the bag loader (integral therewith). Thus, to load a succession of imbricated taped bags, the two used tapes need to be removed from the spools by an operator who also needs to connect the new tapes to the same empty spools in the bag loader.

SUMMARY OF THE INVENTION

The present invention provides an apparatus for taking up a succession of imbricated packaging bags carried by a pair of carrier tapes, said apparatus comprising: two carrier tape winding spools positioned coaxially with one another; and a differential gear unit positioned between said spools, said differential gear unit being adapted to be, in use, removably connectable to a shaft of a bag loader whereby two carrier tapes can be wound up on said spools with equal tension.

Thus the bag loader is less complex with only a single driving shaft and the high number of gears in the differential drive unit of the bag loader are no longer required. The gears of the differential gear unit of the apparatus of the present invention are only required to be used for one bag train and thus may be made of cheap materials, for example of injection moulded plastics. If the apparatus is to be reusable, harder wearing materials may need to be used. Thus, the next set of bags can be easily attached without tools and with only one component to fit onto a single shaft of the bag loader.

The apparatus dimensions can be vastly reduced compared to the cassette dimensions when the two spools were positioned side by side within the cassette. This is only possible because of the coaxial positioning of the differential gear unit with the spools. This results in a lowering of the cost of the apparatus because of the elimination of the need for a cassette housing or reduction in the bulk of the housing with the coaxial arrangement and, as the dimensions are less, the thickness of the walls for a given rigidity and strength can be reduced. The increased cost of the apparatus due to the need to provide it with a differential drive unit is offset by the reduced amount of material needed for the apparatus.

The present invention also provides a method of loading a bag train on a bag loader, comprising: taking a bag train incorporating a succession of imbricated packaging bags on two supply tapes from which they are to be removed during the loading operation, the supply tapes having lead ends equipped with two tape-winding spools with a differential gear unit is positioned coaxially between the spools; connecting the differential gear unit to a shaft of said bag loader; and driving said spools to wind up said tapes on said spools with equal tension to bring each of the imbricated bags successively to a loading position where the bag is loaded and separated from the tapes.

BRIEF DESCRIPTION OF THE DRAWINGS

The invention will be described by way of example only with reference to the accompanying drawings in which.

DETAILED DESCRIPTION OF THE INVENTION

Figure 1:
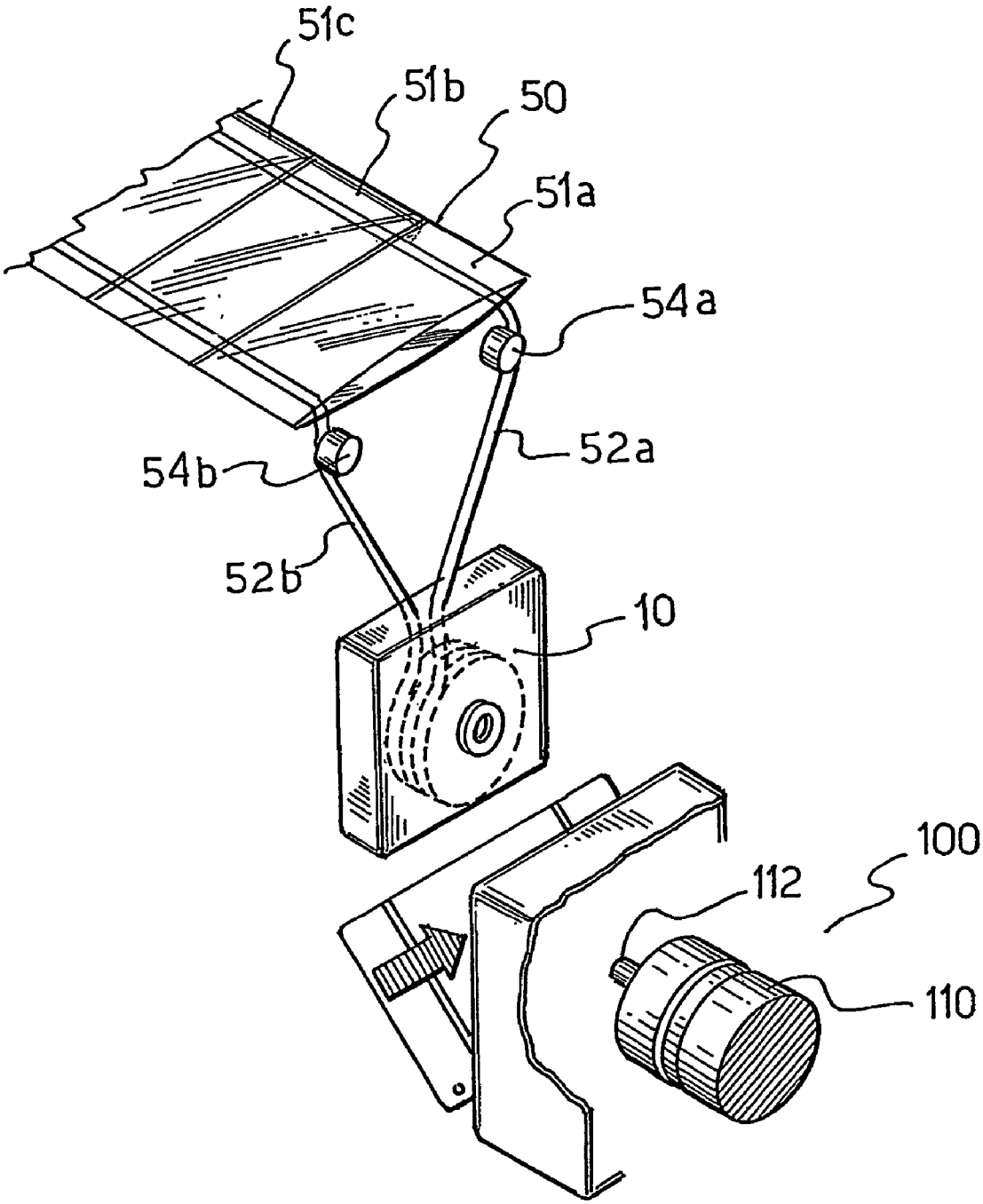
FIG. 1 is a perspective view of a bag train with cassette being loaded on to a bag loader.

FIG. 1 shows schematically how the present invention is employed in use on a bag loader machine 100. A bag train 50 comprises a plurality of packaging bags 51*a*, 51*b*, 51*c* arranged in an imbricated way on two parallel carrier tapes 52*a*, 52*b* (usually about ½ bag width apart). The bags 51*a*, 51*b*, 51*c* are attached to the tapes 52*a*, 52*b* by adhesive. The end of the tapes 52*a*, 52*b* are positioned in a cassette 10. The cassette 10 is loaded by hand, without tools, on to a shaft 112 of the bag loader 100 so that the unit is adapted to be, in use, removably connectable to the shaft. The adaptation may be by way of a snap-on fitting, a butterfly nut, an over center buckle etc. Any way of attaching the unit by hand, without the use of tools, so that little time or skill is required can be used. Although a door to protect the cassette 10 is shown in the figure, in practice this may not be necessary. The shaft 112 is rotated by motor 110. The shaft 112 engages with the cassette 10 and drives the internal workings of the cassette to take up the tapes 52*a*, 52*b*. On taking up of the tapes 52*a*, 52*b* the succession of bags 51*a*, 51*b*, 51*c* are brought closer to the bag loader machine 100. As the tapes are taken up successive bags 51*a*, 51*b*, 51*c* can be removed from the tapes 52*a*, 52*b* and filled.

Figure 2:
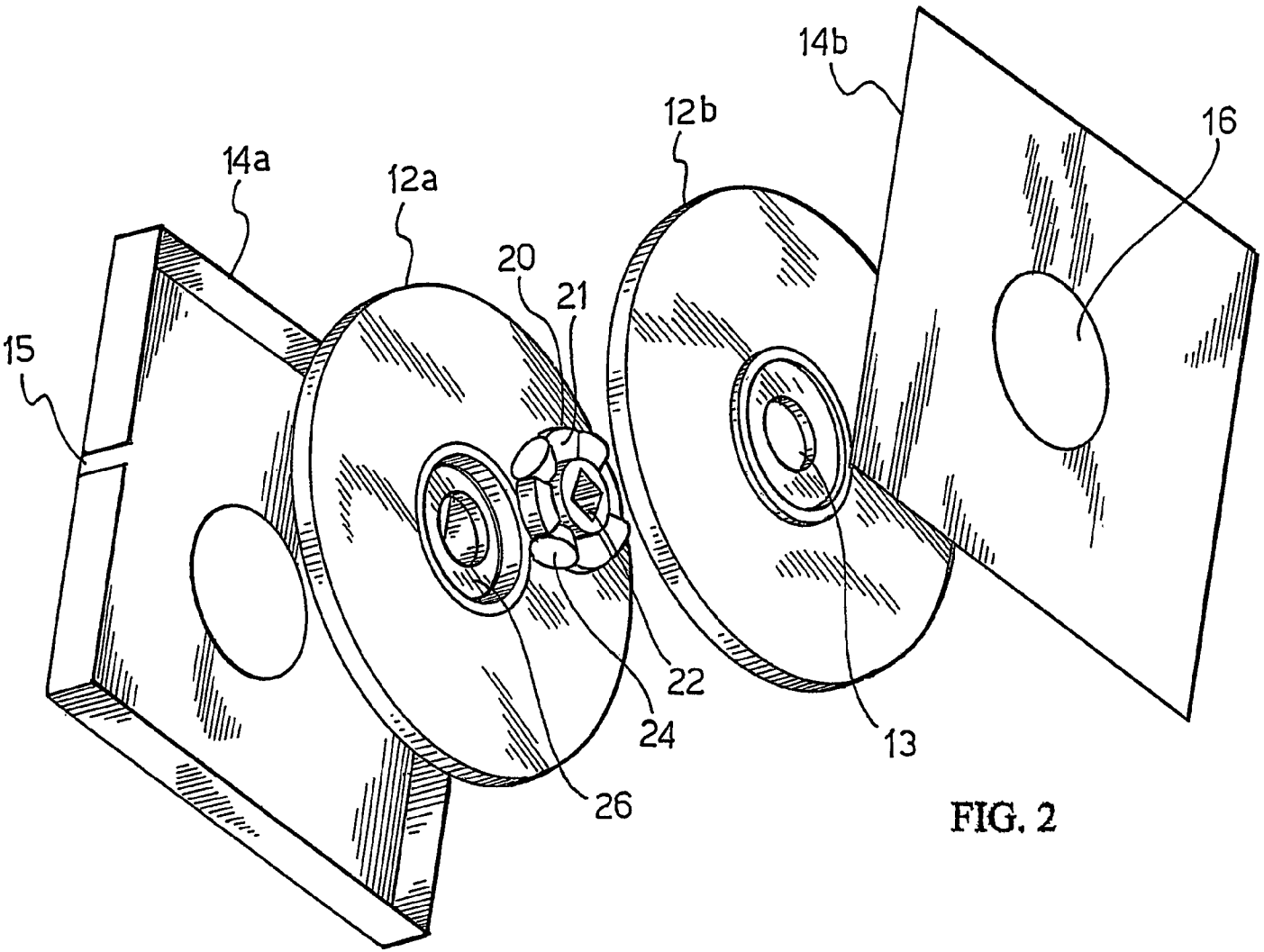
FIG. 2 is an exploded view of a cassette of the present invention.

During drawing of the bags 51*a*, 51*b*, 51*c* towards the bag loader 100, it is necessary to keep the tension in the two tapes 52*a*, 52*b* equal so that the bag openings, usually directed in the direction of advancement, remain in the same orientation to the bag loader 100 (i.e. usually parallel to the bag loader) such that the bags may be removed from the tapes automatically. In the present invention this is done by use of the cassette 10 which ensures that the tapes 52*a*, 52*b*, as they are drawn in towards the bag loader around rollers or stationary pins 54*a*, 54*b*, are kept in equal tension. This is achieved by the internal workings of the cassette 10 which are illustrated in FIG. 2.

The way in which the cassette 10 takes up the carrier tapes 52*a*, 52*b* with equal tension will now be described with reference to FIG. 2. The cassette 10 comprises two carrier tape winding spools 12*a*, 12*b* upon which the tapes 52*a*, 52*b* of the bag train 50 are to be wound. The spools 12*a*, 12*b* are enclosed in a housing of the cassette 10 comprising first and second components 14*a*, 14*b* which can, for example, snap fit together. A slot 15 formed in the first housing component 14*a* allows entry of the tapes 52*a*, 52*b* into the housing and thereby onto spool 12*a* for one tape 52*a* and spool 12*b* for the other tape 52*b*. Two slots may be provided, one for entry of each tape 52*a*, 52*b*. If those slots are positioned as far apart as the tapes are apart when attached to the bags, no rollers or pins 54*a*, 54*b* are required. The tapes 52*a*, 52*b* are attached to the spools 12*a*, 12*b* in any convenient way, for example through a hole in the outer flange of the spool and held in place by a pin inserted in the hole from the outside. The tapes 52*a*, 52*b* are wound around the spools 12*a*, 12*b* in the same direction.

The spools 12*a*, 12*b* are positioned coaxially with one another inside of the housing. Each of the spools 12*a*, 12*b* is depicted as having a central cut out 13 though this is not necessarily the case. In fact, only one of the spools 12*a*, 12*b* will require a central cut out 13 so that the shaft 112 of the bag loader can access a differential gear unit 20 positioned between and coaxially with the spools 12*a*, 12*b*. The shaft 112 passes through the housing 14*b* in a cut out 16, through the central cut out 13 of spool 12*b* to mesh with a mating hole 22 in a core 21 of the differential gear unit 20. Thus, the spools 12*a*, 12*b* and core 21 of the differential gear unit are coaxial with the shaft 112 of the bag loader when the cassette is loaded on the bag loader.

Mounted on the core 21 is at least one bevel pinion 24. In the preferred embodiment there are four bevel pinions 24 positioned symmetrically around the outside of the core 21. The bevel pinions 24 are mounted to the core such that they can freely rotate around an axis perpendicular to the longitudinal axis of mating hole 22.

The differential gear unit 20 is held substantially coaxially with said spools 12*a*, 12*b* by being positioned in recesses in the surfaces of the spools facing each other so that the spools can be positioned close together, possibly even touching. The action of engaging the cassette with the shaft 112 may serve to axially align the spools 12*a*, 12*b* and the core 21 of the differential gear unit and to hold them together. Alternatively, the spools and differential gear unit may be designed to snap fit together (or otherwise held together) without the aid of the cassette 10 or shaft 112 so that the shaft 112 only engages with the differential gear unit 20.

Each of the spools 12*a*, 12*b* is provided with an integrally moulded bevel gear 26 (in the recess) which, when the cassette 10 is assembled, faces the other of said spools 12*a*, 12*b* and meshes with the bevel pinions 24. In this way, if equal tension is present in the tapes 52*a*, 52*b* and the shaft 112 of the bag loader rotates the core 21, the two spools 12*a*, 12*b* will be rotated at the same rate as the bevel pinions 24 will not rotate around their axis of rotation but the whole core and spool assembly will rotate at the same rate around the longitudinal axis of the shaft 112. However, if tension in one of the tapes 52*a*, 52*b* decreases, the spool 12*a*, 12*b* on which that tape is wound will rotate faster than the other spool. This happens because the bevel pinions 24 will begin to rotate until the tension in the tapes 52*a*, 52*b* wound around their respective spools 12*a*, 12*b* is equalised. In this way it is possible to maintain the bag train 50 in an orientation such that each successive imbricated bag 51*a*, 51*b*, 51*c* will arrive at the bag loader in the perfect orientation for removal from the tapes 52*a*, 52*b* as the tapes 52*a*, 52*b* are taken up by the spools 12*a*, 12*b* of the cassette 10.

Figure 3:
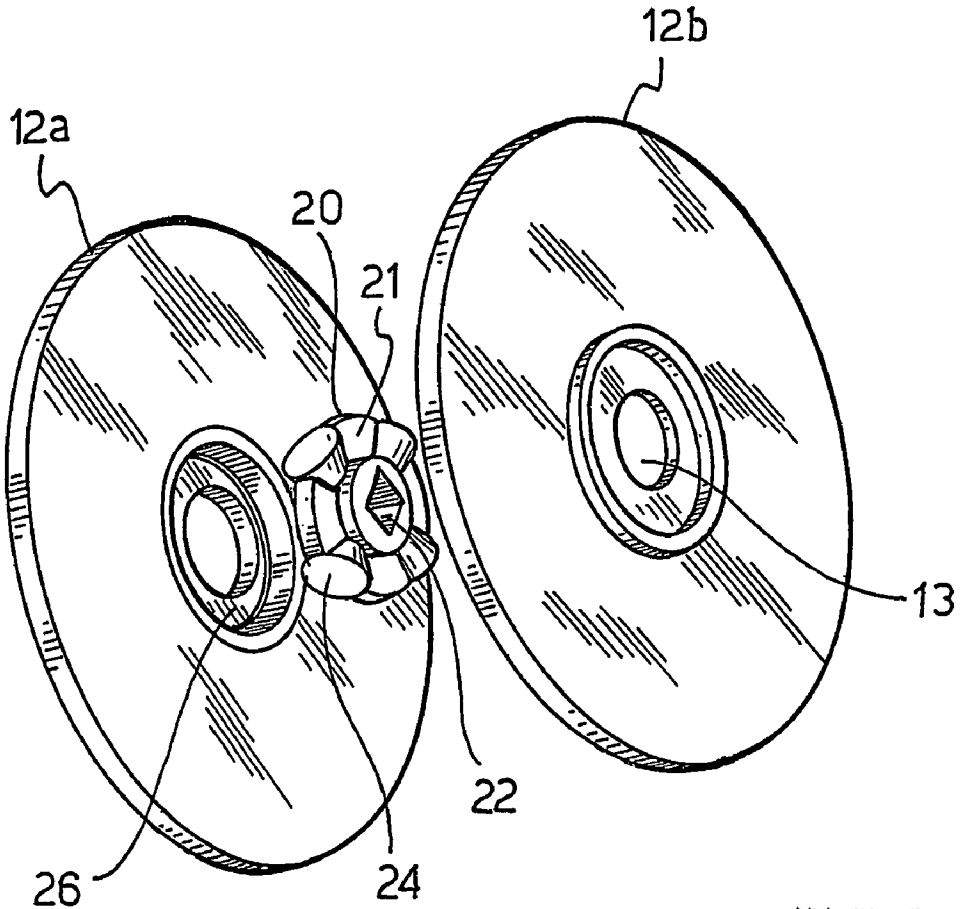
FIG. 3 is an exploded view of the apparatus for taking up a succession of imbricated packaging bags of the present invention.

As will be apparent, the cassette housing is not required for the correct functioning of the invention as shown in FIG. 3. The spools and drive unit could be individually directly assembled onto the shaft 112 or could be assembled on to the shaft 112 as one and be snap fitted or otherwise fixed together for convenience. A lip and flange on the core 21 to engage through a central through hole of the spools would be a satisfactory way of seeing to this.

The cassette housing components 14*a*, 14*b*, spools 12*a*, 12*b* and the parts of the differential gear unit may all be formed by injection moulding of plastics material. This is cheap and the thus produced components easily have the durability to last for the entire bag train which can comprise several hundred bags.

It is envisaged that the cassette will be stored, for example during shipping, with the leading part of each of the tapes connected to the respective spool so that the entire bag chain 50 may be loaded onto the loader easily without first having to connect the tapes 51*a*, 52*b* onto the spools 12*a*, 12*b*.

The cassette 10 can be re-usable. In use, the machine operator would attach the next bag train to the spools of a spare cassette whilst the machine is still working using another bag train. Once that other bag train is finished, the operator can substitute the old cassette for the spare one and restart the machine.

The present invention has been described by way of example only and variations are possible. In particular, as described above, the cassette 10 is not necessary for the functioning of the invention as shown in FIG. 3. The construction of the housing of the cassette could be varied.

The invention claimed is:

1. An apparatus for taking up a succession of imbricated packaging bags carried by a pair of carrier tapes, said apparatus comprising:

a) two carrier tape winding spools positioned coaxially with one another; and b) a differential gear unit positioned between said spools, said differential gear unit adapted to be, in use, removably connectable to a shaft of a bag loader whereby two carrier tapes can be wound up on said spools with equal tension;

wherein said spools each have a recess in a surface which faces the other spool and wherein said differential gear unit is positioned in said recesses.

2. An apparatus according to claim 1, wherein said spools and differential gear unit are positioned in a cassette housing.

3. An apparatus according to claim 1, wherein said differential gear unit is removably connectable to said shaft without the use of tools.

4. An apparatus for taking up a succession of imbricated packaging bags carried by a pair of carrier tapes, said apparatus comprising:

a) two carrier tape winding spools positioned coaxially with one another; and b) a differential gear unit positioned between said spools, said differential gear unit adapted to be, in use, removably connectable to a shaft of a bag loader whereby two carrier tapes can be wound up on said spools with equal tension;

wherein each of said spools is integrally formed with a bevel gear coaxial with said spool.

5. An apparatus according to claim 4, wherein said differential gear unit comprises a core and at least one pinion gear attached to said core and positioned to mesh with each bevel gear.

6. An apparatus according to claim 5 wherein said core comprises a mating hole for mating with the shaft of a bag loader.

7. An apparatus according to claim 4, wherein said spools and differential gear unit are positioned in a cassette housing.

8. An apparatus according to claim 4, wherein said differential gear unit is removably connectable to said shaft without the use of tools.

* * * * *